United States Patent [19]

Malamoud

[11] 3,938,943

[45] Feb. 17, 1976

[54] SECURITY DEVICE FOR A PORTABLE LIGHTER

[75] Inventor: Jean Gaston Malamoud, Annecy, France

[73] Assignee: S.T. Dupont, Paris, France

[22] Filed: Feb. 28, 1974

[21] Appl. No.: 447,050

[30] Foreign Application Priority Data

Mar. 1, 1973 France ..... 73.07291

[52] U.S. Cl. ..... 431/150; 431/144

[51] Int. Cl.[2] ..... F23Q 25/00

[58] Field of Search ..... 431/144, 150, 154, 254, 431/255, 276, 277, 350; 222/153, 402.11, 541

[56] References Cited

UNITED STATES PATENTS

| | | | |
|---|---|---|---|
| 3,125,259 | 3/1964 | Young | 222/541 |
| 3,158,292 | 11/1964 | O'Donnell | 222/402.11 |
| 3,266,676 | 8/1966 | McKernan | 222/541 |
| 3,521,985 | 7/1970 | Crisman et al. | 431/154 |
| 3,601,517 | 8/1971 | Rosenthal | 431/354 |
| 3,816,058 | 6/1974 | Court | 431/254 |
| 3,854,862 | 12/1974 | Webster | 431/254 |

*Primary Examiner*—Carroll B. Dority, Jr.
*Attorney, Agent, or Firm*—Haseltine, Lake & Waters

[57] ABSTRACT

A security device for a lighter having an externally operated actuator lever which opens and closes a gas valve. The security device comprises a security member secured to the lighter for preventing operation of the actuator lever, the security member being attached to the lighter by at least one line of weakness so as to be separable from the lighter to free the actuator lever. The security member can enclose the lever to prevent access thereto, or it can abut the lever to block movement thereof.

6 Claims, 6 Drawing Figures

SECURITY DEVICE FOR A PORTABLE LIGHTER

FIELD OF THE INVENTION

The invention relates to a security device adapted for use with a portable lighter to guarantee the inviolability of the actuator lever of a gas valve of such lighter.

In this way, the purchaser of the lighter is assured that the lighter has not been previously used.

SUMMARY OF THE INVENTION

The security device of the invention is applicable to lighters having externally operated actuator levers for opening and closing a gas valve, the security device comprising a portion preventing actuation of the lever and fixed to the lighter by at least one part of least resistance by which the security device can be separated to free the actuator lever.

In one embodiment of the invention, the security device surrounds the control region, i.e. by enclosing at least part of the actuator lever.

In a second embodiment, the security device comprises an abutment fixed under the actuator lever.

In the first embodiment, the actuator lever is free but access thereto is prevented, whereas in the second embodiment the actuator lever is accessible, but is prevented from moving by the abutment.

DETAILED DESCRIPTION

Figure 1:
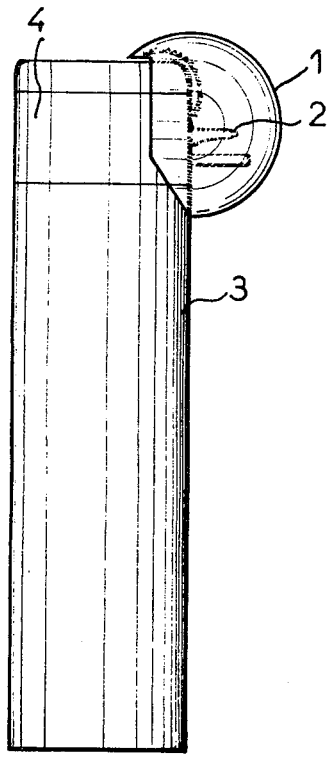
FIG. 1 is a side elevational view showing a lighter equipped with a security device according to a first embodiment of the invention.
Figure 2:
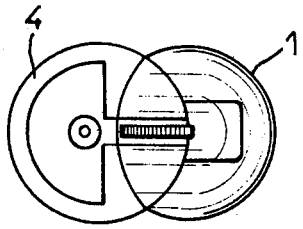
FIG. 2 is a plan view of the lighter of FIG. 1.
Figure 3:
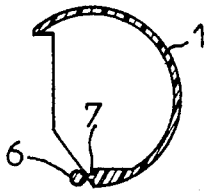
FIG. 3 is a sectional view taken on a median plane through the security device of FIG. 1.

Referrisng to FIGS. 1–3, therein is seen a lighter with a security device which is intended to prevent operation of the lighter prior to its purchase and to thereby insure the purchaser that the lighter is fresh and has not been used or tampered with. The security device comprises a hollow bubble member 1 of substantially spherical shape mounted around a control lever 2 which opens and closes a gas valve of the lighter 3. The hollow member 1 cooperates with adjacent portions of the lighter to enclose the valve lever 2 and to render this inaccessible to the finger of a user or even to a pointed actuator element. The hollow member is constituted of a plastic material which can be molded integrally with a portion of the lighter, for example, with the head thereof. In this case, it can include zones of weakness along which it can be broken, such as for example, by reduced thickness along lines of weakness.

The security member 1 illustrated in FIG. 3 is a separate part which includes a tab 6 adapted to be fixedly held in a corresponding recess provided in the head 4 of the lighter. The tab 6 is attached to the remainder of member 1 by a thin portion 7 of least resistance adapted to facilitate breakage of member 1 at the portion 7.

By means of the above construction, when member 1 is intact on the lighter, the actuator lever is inaccessible and the lighter can not be operated. The purchaser can easily break the member 1 to gain access to the actuator lever and thereby be assured that the lighter is fresh and has not hitherto been used.

Figure 4:
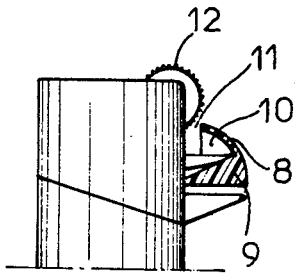
FIG. 4 is a side elevational view, partially in section, of a lighter provided with a second embodiment of a security device according to the invention.

In the embodiment of FIG. 4, the security device comprises an upper portion 8, a lower portion 9 wedged just beneath the actuator lever of the valve, and lateral side walls 10. In this construction, the security device surrounds the valve lever without completely enclosing it. The introduction of a pointed instrument in the space 11 formed between portion 8 and flint wheel 12 cannot actuate lever 2, since the lever is blocked by lower portion 9 of the security device. The security device can either be integrally moulded with the head of the lighter or connected thereto by a locked connection as with the previously described embodiment.

Figure 5:
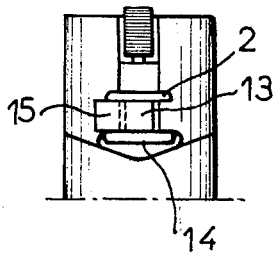
FIG. 5 is a rear elevational view of a lighter provided with a third embodiment of a security device, according to the invention.
Figure 6:
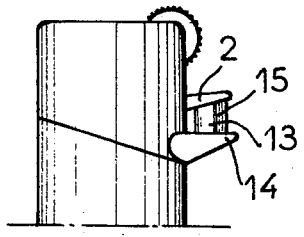
FIG. 6 is a side elevational view of the lighter of FIG. 5.

Referring to FIGS. 5 and 6, therein the security device is constituted by a simple abutment 13 wedged between the valve lever 2 and the heel 14 of the lighter. The abutment 13 comprises a removal tab 15 by which the abutment is seized to be removed. The abutment is fixed to the heel 14 by any suitable means of attachment which can be overcome by application of force to tab 15. A suitable adhesive or other operative means (not shown) is within the contemplation of the invention.

Numerous modifications can be made of the detailed embodiments which have been disclosed without departing from the frame work of the invention. The security device can, for example, completely enclose the head of the lighter. Preferably, however, the actuator lever for the valve of the lighter is rendered inoperative by one of the embodiments of the security device according to the invention.

What is claimed is:

1. A security device for a lighter having an externally operated actuator lever for opening and closing a valve, and a flint wheel in spaced relation adjacent said actuator lever, said security device comprising a security member secured to the lighter and including means arranged in proximity to the actuator lever and flint wheel for preventing operation of the actuator lever and substantially closing the space between the flint wheel and the actuator lever to prevent access therebetween, said security member being separable from the lighter to free the actuator lever, said means for preventing operation of the actuator lever including a first portion abutting against said lever from below to prevent downward operation thereof and a second portion attached to said first portion and extending upwardly therefrom to be interposed in the space between said lever and flint wheel to prevent access to said space while enclosing the actuator lever from above.

2. A security device as claimed in claim 1 wherein said security member is integrally moulded with the lighter.

3. A security device as claimed in claim 2 wherein said security member includes means securely attached to the lighter and means defining a line of weakness along which the security member can be broken to provide access to the actuator lever.

4. A security device as claimed in claim 1 wherein said first portion includes a wedge portion fitted beneath the lever and lateral side walls joining said first and second portions.

5. A security device for a lighter having an externally operated actuator lever for opening and closing a valve, and a flint wheel in spaced relation adjacent said actuator lever, said security device comprising a security member secured to the lighter and including means arranged in proximity to the actuator lever and flint wheel for preventing operation of the actuator lever and substantially closing the space between the flint wheel and the actuator lever to prevent access therebetween, said security member being separable from the lighter to free the actuator lever, said means for preventing operation of the actuator lever comprising a hollow bubble member covering only a portion of the top and side of the lighter to enclose the flint wheel and the actuator lever, said hollow bubble member including a tab piece fixedly held in a recess provided in said lighter and a relatively thin portion defining a line of weakness adjacent said tab to permit removal of the bubble member by breakage thereof at said thin portion.

6. A security device as claimed in claim 5 wherein said tab is fixedly held in said recess.

* * * * *